US007654118B2

(12) United States Patent
Lee et al.

(10) Patent No.: US 7,654,118 B2
(45) Date of Patent: Feb. 2, 2010

(54) LAUNDRY AMOUNT SENSING APPARATUS AND METHOD FOR WASHING MACHINE

(75) Inventors: Dong-Soo Lee, Seoul (KR); Dong-Won Kim, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 554 days.

(21) Appl. No.: 11/515,423

(22) Filed: Sep. 5, 2006

(65) Prior Publication Data

US 2007/0050916 A1 Mar. 8, 2007

(30) Foreign Application Priority Data

Sep. 5, 2005 (KR) ..... 10-2005-0082322

(51) Int. Cl.
*D06F 33/00* (2006.01)

(52) U.S. Cl. ..... 68/12.04; 68/12.02; 68/12.05; 68/12.06; 8/158

(58) Field of Classification Search ..... 68/12.04, 68/12.06, 24, 25

See application file for complete search history.

(56) References Cited

U.S. PATENT DOCUMENTS

2006/0048549 A1* 3/2006 Matsukura et al. ..... 68/12.06

OTHER PUBLICATIONS

Michelle Clifford et al.; "Measuring Tilt with Low-g Accelerometers"; Freescale Semiconductor, Inc. 2005; Application Note, Sensor Products, Tempe, AZ, Rev 0. May 2005; pp. 1-8.

Kimberly Tuck; "Tilt Sensing Using Linear Accelerometers"; Freescale Semiconductor, Inc. 2007; Application Note, Accelerometer Systems and Applications Engineering, Tempe, AZ, Rev 2. May 2007; pp. 1-8.

* cited by examiner

*Primary Examiner*—Michael Barr
*Assistant Examiner*—David Cormier
(74) *Attorney, Agent, or Firm*—McKenna Long & Aldridge LLP

(57) ABSTRACT

The present invention discloses a laundry amount sensing apparatus and method for a washing machine. The laundry amount sensing apparatus for the washing machine in which a tub is inclined at a predetermined angle in a non-load state includes a control unit that senses an inclination of the tub, determines a laundry amount corresponding to the sensed inclination of the tub, and controls a spin-drying speed according to the selected laundry amount.

10 Claims, 6 Drawing Sheets

LAUNDRY AMOUNT SENSING APPARATUS AND METHOD FOR WASHING MACHINE

This application claims the benefit of Korean Patent Application No. 10-2005-0082322, filed on Sep. 5, 2005, which is hereby incorporated by reference for all purposes as if fully set forth herein.

BACKGROUND OF THE INVENTION

1. Field of the Invention

The present invention relates to a washing machine, and more particularly, to a laundry amount sensing apparatus and method for a washing machine which can precisely detect a laundry amount by using a correlation between an inclination of a wash tub and a laundry amount.

2. Description of the Background Art

In general, a washing machine applies a mechanical operation such as friction or vibration to the laundry put into a washing solution, thereby separating contaminants from the laundry.

The washing machine performs a washing step that applies a mechanical force to the laundry mixed with the washing solution, a rinsing step that separates the washing solution containing contaminants from the laundry, and a spin-drying step that removes rinse water from the laundry.

When the laundry is not evenly distributed in the washing machine, namely, when the laundry is unbalanced, serious vibration and noise occur in the spin-drying operation.

Therefore, the washing machine needs a laundry leveling function that detects unbalanced laundry and evenly distributes the laundry according to the detected unbalance.

FIG. 1 is a schematic diagram illustrating a structure of a conventional drum type washing machine.

Referring to FIG. 1, the conventional drum type washing machine includes: a housing 11 that provides the shape of a main body; a suspension device 12 including a spring and a damper in the housing 11; an outer water tub 13 supported by the suspension device 12; a drum type inner rotating tub 14 positioned in the outer water tub 13, for washing the laundry; a driving unit 15 for rotating the inner rotating tub 14; and a rotation shaft 16 for transferring a driving force of the driving unit 15.

In the washing and rinsing operations of the drum type washing machine, water is supplied to the inner rotating tub 14. When the water level in the inner rotating tub 14 reaches an appropriate water level, the supply of water is stopped.

The inner rotating tub 14 is repeatedly rotated in the forward or backward direction by the driving force generated by the driving unit 15.

In the spin-drying operation, water supplied to the inner rotating tub 14 is drained off. The inner rotating tub 14 is first rotated at a low speed in the forward or backward direction by the driving force of the driving unit 15 for performing the laundry leveling function and then is accelerated to a spin-drying speed for performing the spin-drying operation.

The spin-drying operation needs precise sensing of the amount of laundry in the inner rotating tub 14.

As shown in FIG. 2, a conventional laundry amount sensing method for a drum type washing machine calculates a sum of PWM duties required to reach a specific RPM, and a sum of RPM errors generated in a specific period maintaining the specific RPM.

The difference between the sum of the PWM duties required to reach the RPM and the sum of the RPM errors is determined as a laundry amount data.

However, the conventional laundry amount sensing method for the drum type washing machine drives the motor of the washing machine to sense the laundry amount, which increases power consumption.

In addition, the conventional laundry amount sensing method for the drum type washing machine cannot precisely sense the laundry amount according to the laundry quality.

Furthermore, the conventional laundry amount sensing method for the drum type washing machine does not sense the laundry amount by a single load, thereby causing an unbalance sensing error.

SUMMARY OF THE INVENTION

Therefore, an object of the present invention is to provide a laundry amount sensing apparatus and method for a washing machine which can precisely detect a current laundry amount of the washing machine by using a correlation between an inclination of a tub and laundry amount.

To achieve these and other advantages and in accordance with the purpose of the present invention, as embodied and broadly described herein, there is provided a laundry amount sensing apparatus for the washing machine in which a tub is inclined at a predetermined angle in a non-load state includes a control unit that senses an inclination of the tub, determines a laundry amount corresponding to the sensed inclination of the tub, and controls a spin-drying speed according to the selected laundry amount.

According to another aspect of the present invention, there is provided a laundry amount sensing apparatus for a washing machine in which a tub is inclined at a predetermined angle in a non-load state, the apparatus including: a storing unit that stores laundry amount corresponding to each inclination of the tub in advance; a sensing unit that senses the inclination of the tub; and a control unit that selects the laundry amount corresponding to the inclination sensed by the inclination sensing unit from the storing unit, and controlling a spin-drying speed according to the selected laundry amount.

According to yet another aspect of the present invention, there is provided a laundry amount sensing method for a drum type washing machine inclined at a predetermined angle in a non-load state including a step for sensing an inclination of a tub, and sensing a laundry amount corresponding to the sensed inclination of the tub.

According to yet another aspect of the present invention, there is provided a laundry amount sensing method for a drum type washing machine inclined at a predetermined angle in a non-load state, the method including the steps of: storing laundry amount corresponding to each inclination of a tub; sensing the inclination of the tub; and selecting the laundry amount corresponding to the sensed inclination of the tub among the previously-stored laundry amount.

According to yet another aspect of the present invention, there is provided a laundry amount sensing method for a drum type washing machine inclined at a predetermined angle in a non-load state including: determining a formula describing a correlation between an inclination of a tub and a laundry amount; and sensing the inclination of the tub, and determining the laundry amount based upon the sensed inclination of the tub and the formula.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A laundry amount sensing apparatus and method for a washing machine which can reduce power consumption of the washing machine and shorten a spin-drying operation time and a washing operation time by precisely detecting a current laundry amount in the washing machine by using a correlation between an inclination of a tub and a laundry amount will now be described in detail with reference to the accompanying drawings.

Figure 1:
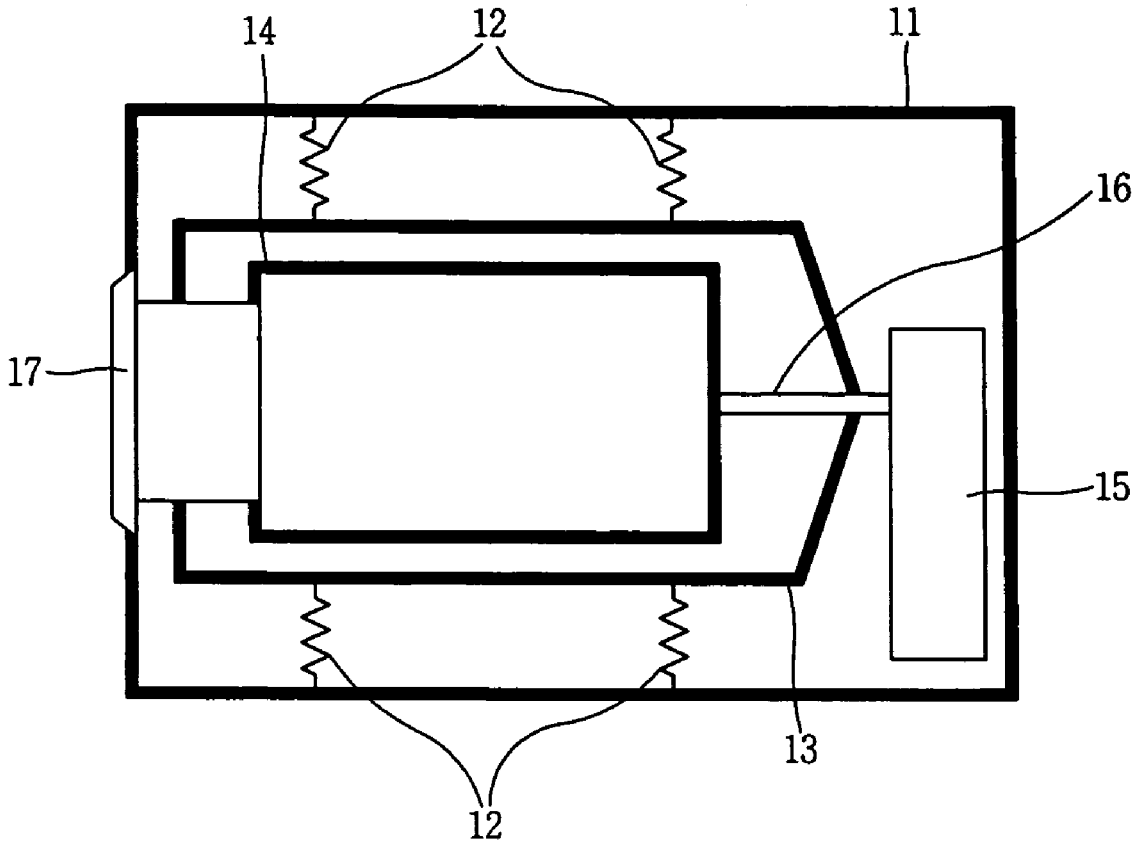
FIG. 1 is a schematic diagram illustrating a structure of a conventional drum type washing machine.
Figure 2:
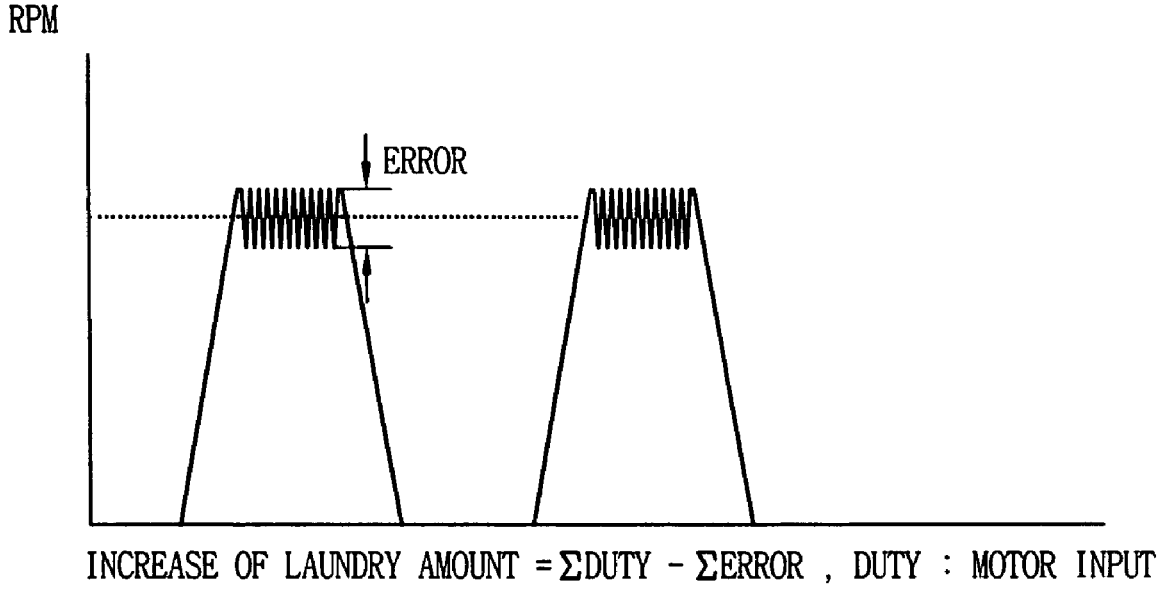
FIG. 2 is a graph showing a process of determining a laundry amount data by using RPM in FIG. 1.
Figure 3:
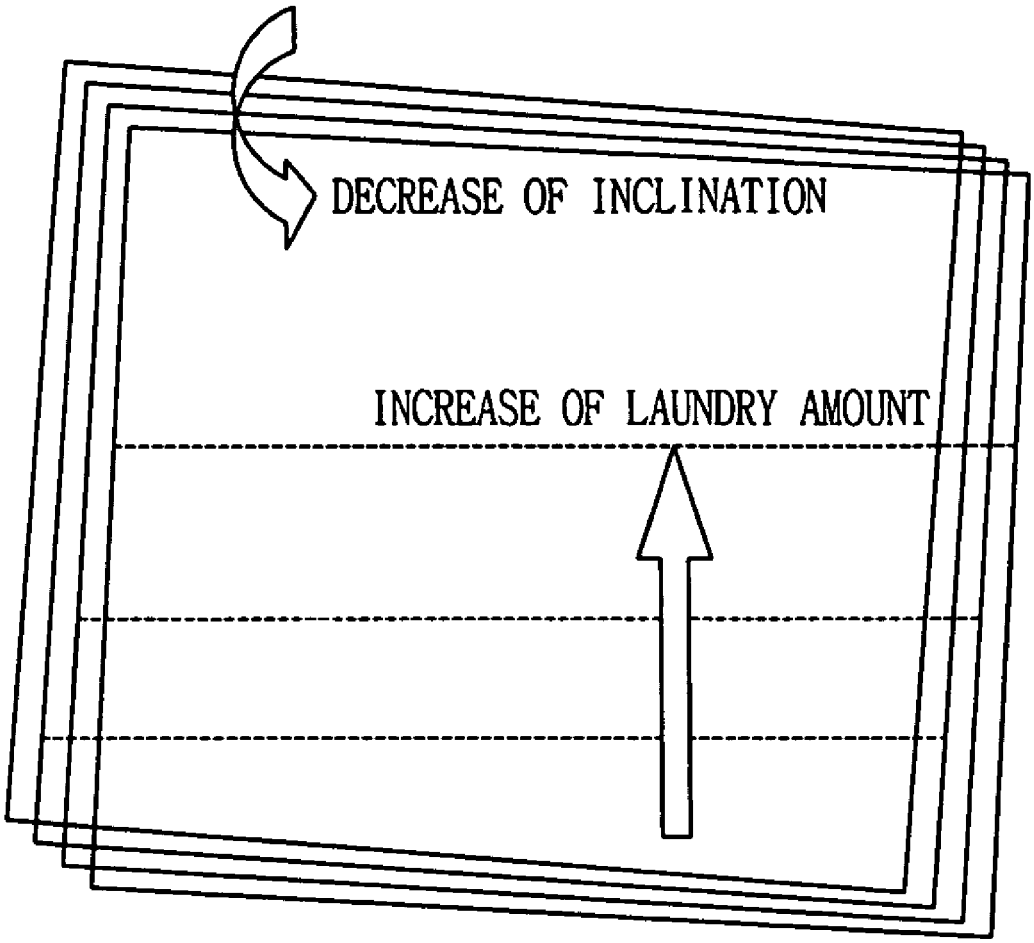
FIG. 3 illustrates a state wherein a gravity center of a tub of the washing machine moves forward due to increase of a laundry amount.

The laundry amount sensing apparatus for the washing machine grew out of the fact that a center of gravity moves to a front surface of a tub due to increase of a laundry amount and changes the inclination of the tub as shown in FIG. 3.

Figure 4:
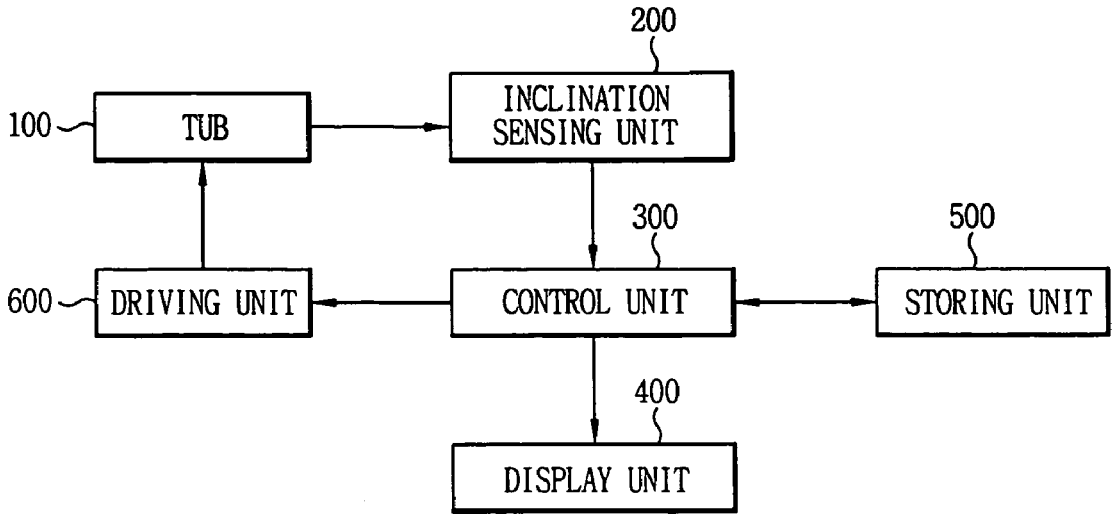
FIG. 4 is a block diagram illustrating a structure of a laundry amount sensing apparatus for a washing machine in accordance with a preferred embodiment of the present invention.

FIG. 4 is a block diagram illustrating the structure of the laundry amount sensing apparatus for the washing machine in accordance with the present invention.

As shown in FIG. 4, the laundry amount sensing apparatus for the washing machine includes a tub 100, an inclination sensing unit 200, a storing unit 500, a control unit 300, a display unit 400 and a driving unit 600.

The tub 100 is inclined at a predetermined angle in a non-load state. The center of gravity of the tub 100 moves forward as the laundry amount increases.

The inclination sensing unit 200 for sensing an inclination of the tub 100 is placed in an optimum position for sensing the inclination of the tub 100.

Figure 5:
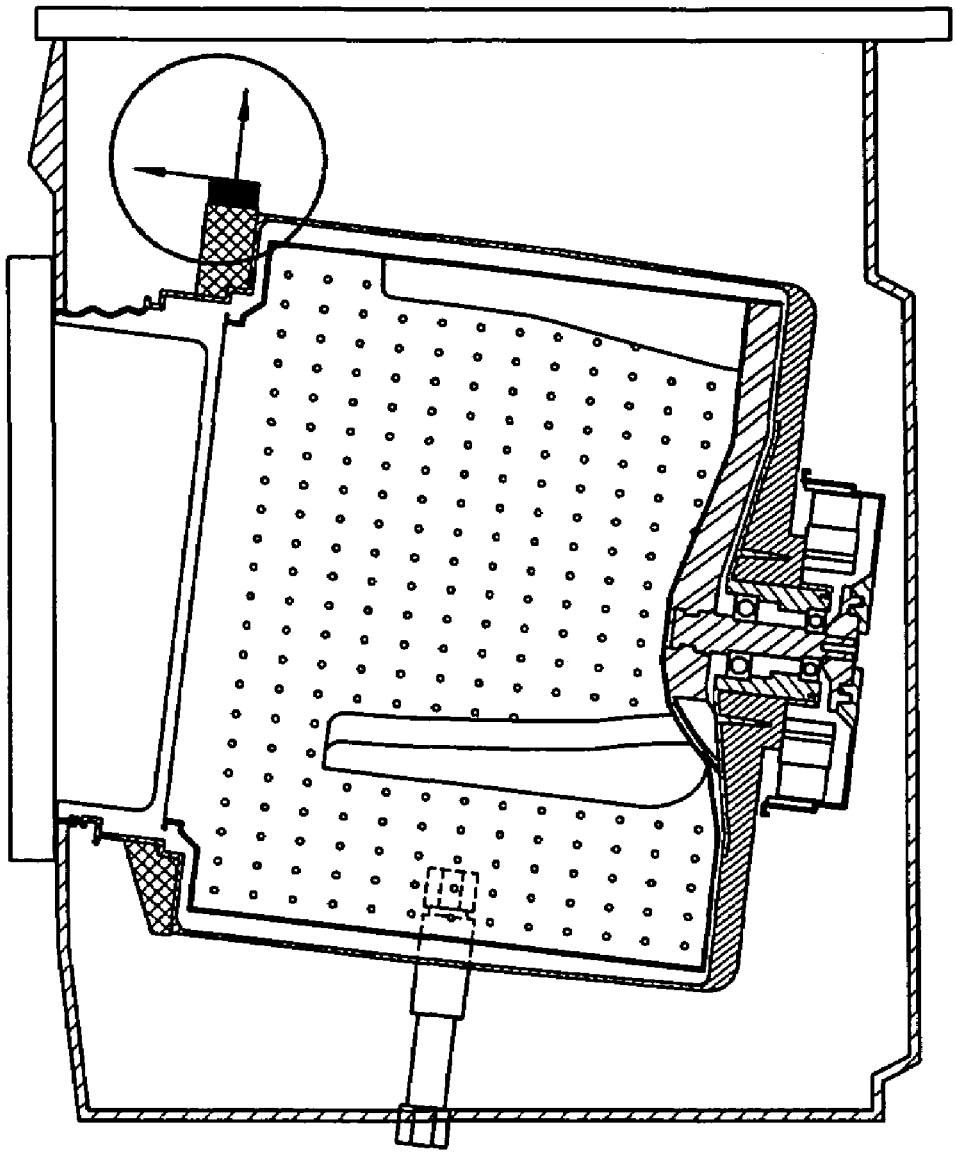
FIG. 5 illustrates a state wherein an inclination sensing unit is adhered to a tub in FIG. 4.

As depicted in FIG. 5, the inclination sensing unit 200 is placed on the top surface of the tub 100.

An acceleration sensor, a mercury sensor or a transmission-type photo sensor may be employed as the inclination sensing unit 200.

Preferably, the acceleration sensor for sensing acceleration on two or more axes is used as the inclination sensing unit 200.

The storing unit 500 stores inclinations corresponding to variations of the laundry amount in advance by experiment.

The storing unit 500 may be a ROM table for storing the inclinations corresponding to the laundry amount.

The control unit 300 controls the whole operation of the washing machine.

The control unit 300 selects the laundry amount corresponding to the inclination sensed by the inclination sensing unit 200 from the storing unit 500.

In addition, the control unit 300 performs spin-drying related control on the basis of the sensed laundry amount.

The display unit 400 displays the current washing operation state and the remaining time.

The driving unit 600 drives the tub 100 at a predetermined speed under the control of the control unit 300.

Figure 6:
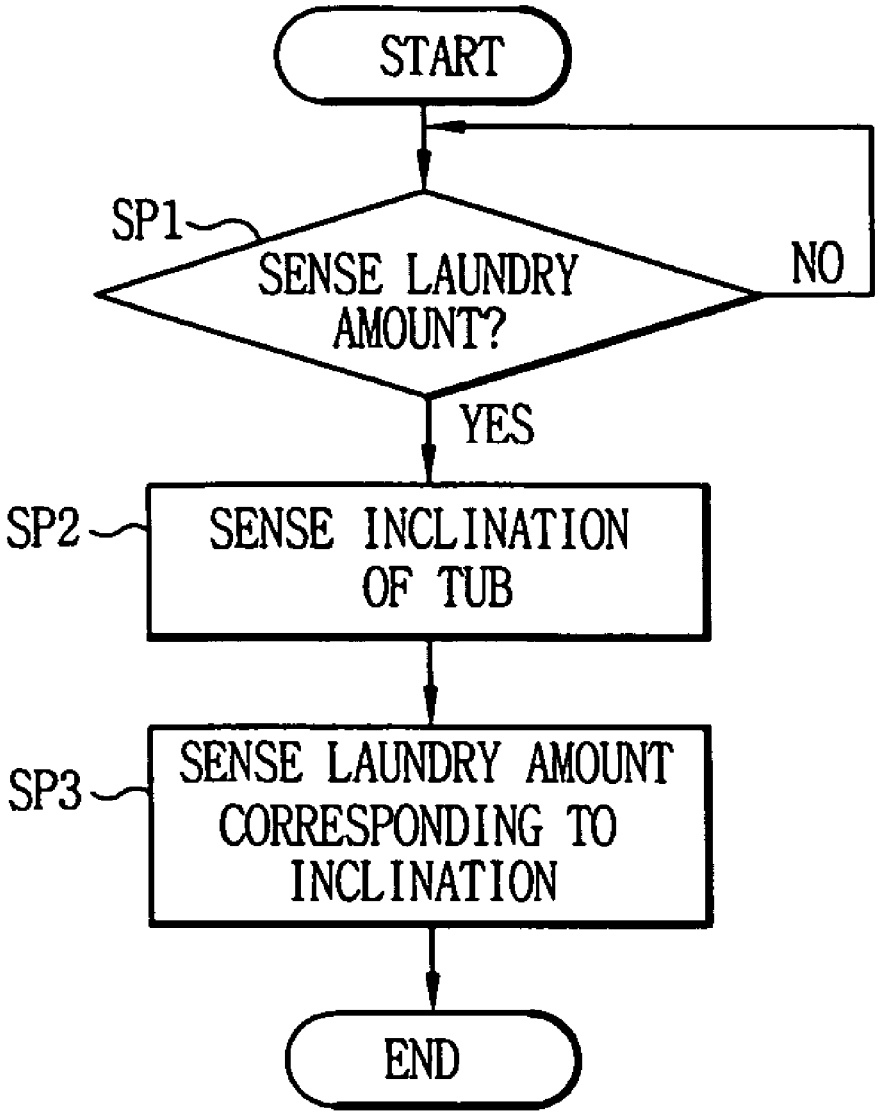
FIG. 6 is a flowchart showing a laundry amount sensing method for a washing machine in accordance with a preferred embodiment of the present invention.

The laundry amount sensing method for the washing machine in accordance with the present invention will now be described in more detail with reference to FIG. 6.

The storing unit 300 stores data representing the correlation between the inclination of the tub 100 and the laundry amount in advance by experiment.

The inclination of the tub 100 decreases as the laundry amount in the tub 100 increases.

That is, the laundry put into the tub 100 is increased by a predetermined amount, and the change in inclination is detected verses the changes in the laundry amount and is stored in the storing unit 500 in the form of database.

In order to detect the laundry amount during the washing operation, the inclination sensing unit 200 senses the inclination of the tub 100 and applies the sensed inclination to the control unit 300.

In accordance with one embodiment of the present invention, the control unit 300 selects the laundry amount corresponding to the inclination sensed by the inclination sensing unit 200 from the storing unit 500.

In accordance with another embodiment of the present invention, the control unit 300 detects the current laundry amount by using a formula obtained by the correlation between the inclination and the laundry amount.

That is, the control unit 300 makes a graph of the laundry amount corresponding to the inclinations detected by experiment, and converts the graph into a formula.

The control unit 300 controls the spin-drying operation according to the laundry amount.

That is, the control unit 300 controls the revolution speed of the tub 100 to be an appropriate speed according to the laundry amount.

In accordance with the present invention, the laundry amount is detected by sensing the inclination of the tub of the washing machine. Differently from the conventional art, the operation of driving the motor of the washing machine is not required to sense the laundry amount. Also, the time of detecting the laundry amount after the washing operation is reduced to thereby shorten the spin-drying time.

As discussed earlier, the laundry amount sensing apparatus and method for the washing machine can precisely detect the current laundry amount of the washing machine by using the correlation between the inclination of the tub and the laundry amount.

As a result, the laundry amount sensing apparatus and method for the washing machine may reduce power consumption of the washing machine and shorten the spin-drying time and the washing time by precisely detecting the current laundry amount of the washing machine by using the correlation between the inclination of the tub and the laundry amount.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A laundry amount sensing apparatus for a washing machine in which a tub is inclined with respect to vertical in a non-load state, the apparatus comprising:

a storing unit that stores a laundry amount corresponding to each inclination of the tub in advance;

a sensing unit that senses the inclination of the tub; and a control unit that selects the laundry amount corresponding to the inclination sensed by the inclination sensing unit from the storing unit, and controlling a dehydrating speed according to the selected laundry amount.

2. The laundry amount sensing apparatus as claimed in claim 1, wherein the inclination sensing unit is an acceleration sensor.

3. The laundry amount sensing apparatus as claimed in claim 1, wherein the inclination sensing unit is attached to the tub.

4. The laundry amount sensing apparatus as claimed in claim 1, wherein the storing unit is a ROM table that stores the inclination corresponding to variations of the laundry amounts.

5. The laundry amount sensing apparatus as claimed in claim 1, wherein the storing unit stores the laundry amount corresponding to the inclinations in an inverse proportional relation.

6. The laundry amount sensing apparatus as claimed in claim 1, wherein the control unit detects the laundry amount corresponding to the current inclination by using a formula describing the correlation between the inclination and the laundry amount.

7. A laundry amount sensing method for a drum type washing machine, in which a tub is inclined with respect to vertical in a non-load state, comprising: storing data representing laundry amount versus inclination of a tub; sensing the inclination of the tub; and selecting the laundry amount corresponding to the sensed inclination of the tub among the previously-stored laundry amount.

8. The laundry amount sensing method as claimed in claim 7, wherein storing the laundry amount includes storing the inclinations corresponding to variations of the laundry amount in an inverse proportional relation.

9. A laundry amount sensing method for a drum type washing machine, in which a tub is inclined with respect to vertical in a non-load state, comprising: determining a formula describing a correlation between an inclination of a tub and a laundry amount; and sensing the inclination of the tub; and determining the laundry amount based upon the sensed inclination of the tub and the formula.

10. The laundry amount sensing method as claimed in claim 9, wherein determining the formula including making a graph of the laundry amount corresponding to the inclinations of the tub detected by experiment, and obtaining the formula by using the graph.

* * * * *